US010964274B2

(12) United States Patent
Kang

(10) Patent No.: US 10,964,274 B2
(45) Date of Patent: Mar. 30, 2021

(54) METHOD OF SENSING CHARACTERISTIC VALUE OF CIRCUIT ELEMENT AND DISPLAY DEVICE USING IT

(71) Applicant: LG Display Co., Ltd., Seoul (KR)

(72) Inventor: Haeyoon Kang, Gyeonggi-do (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

(21) Appl. No.: 16/675,660

(22) Filed: Nov. 6, 2019

(65) Prior Publication Data

US 2020/0152135 A1 May 14, 2020

(30) Foreign Application Priority Data

Nov. 9, 2018 (KR) ..... 10-2018-0137091

(51) Int. Cl.
*G09G 3/3266* (2016.01)
*G09G 3/3291* (2016.01)

(52) U.S. Cl.
CPC ..... *G09G 3/3291* (2013.01); *G09G 3/3266* (2013.01); *G09G 2300/0842* (2013.01); *G09G 2310/0291* (2013.01); *G09G 2320/0233* (2013.01)

(58) Field of Classification Search
CPC .. G09G 3/3266; G09G 3/3291; G09G 3/3225; G09G 3/006; G09G 3/325; G09G 3/3258; G09G 3/3208; G09G 3/3275; G09G 3/323; G09G 2310/0291; G09G 2310/066; G09G 2310/0251; G09G 2320/0233; G09G 2320/02357; G09G 2320/0285; G09G 2320/0295; G09G 2320/045; G09G 2300/0842
See application file for complete search history.

(56) References Cited

U.S. PATENT DOCUMENTS

2016/0071445 A1* 3/2016 Kim ..... G09G 3/006 345/212
2016/0125811 A1* 5/2016 Park ..... G09G 3/3258 345/694
2017/0193923 A1* 7/2017 Park ..... G09G 3/3258

* cited by examiner

*Primary Examiner* — Ryan A Lubit
(74) *Attorney, Agent, or Firm* — Seed IP Law Group LLP

(57) ABSTRACT

A display device and a method of driving the same. Characteristics of driving transistors disposed in subpixels of a display panel are sensed and compensated for, thereby improving the image quality of the organic light-emitting display device. Changes in a data voltage between a point in time at which a blank period starts and a period in which the sensing of the driving transistors starts are reduced or minimized, thereby reducing deviations in the sensing of the characteristics of the driving transistors.

14 Claims, 13 Drawing Sheets

Display before sensing

Display after sensing

METHOD OF SENSING CHARACTERISTIC VALUE OF CIRCUIT ELEMENT AND DISPLAY DEVICE USING IT

CROSS REFERENCE TO RELATED APPLICATION

This application claims priority to Korean Patent Application No. 10-2018-0137091, filed on Nov. 9, 2018, which is hereby incorporated by reference for all purposes as if fully set forth herein.

BACKGROUND

Technical Field

The present disclosure generally relates to a method of sensing characteristic value of circuit element and display device using it.

Description of the Related Art

With the development of the information society, there has been an increasing demand for a variety of types of image display devices. In this regard, a range of display devices, such as liquid crystal display (LCD) devices, plasma display devices, and organic light-emitting diode (OLED) display devices, have recently come into widespread use.

Among such display devices, organic light-emitting display devices have superior properties, such as rapid response speeds, high contrast ratios, high emissive efficiency, high luminance, and wide viewing angles, since self-emissive organic light-emitting diodes (OLEDs) are used.

Such an organic light-emitting display device may include organic light-emitting diodes disposed in a plurality of subpixels SP aligned in a display panel, and may control the organic light-emitting diodes to emit light by controlling a voltage flowing through the organic light-emitting diodes, so as to display an image while controlling luminance of the subpixels.

In such an organic light-emitting display device, an organic light-emitting diode (OLED) and a driving transistor to drive organic light-emitting diode (OLED) are disposed in each subpixel SP defined in the display panel. At this time, there may be deviations in the characteristics of transistors in each subpixel SP, such as threshold voltage or mobility, due to changes over the driving time or by different driving times among the subpixels SP. Accordingly, luminance deviations (or luminance non-uniformity) may occur among the subpixels SP, thereby degrading image quality.

BRIEF SUMMARY

Various solutions for sensing deviations in the characteristics of driving transistors and compensating for such deviations have been proposed in order to remove luminance deviations among the subpixels SP of the organic light-emitting display device. However, despite such solutions for sensing and compensating, display images may have failure due to sensing errors occurring for unexpected reasons.

In particular, in a case for sensing and compensating of the characteristics of the driving transistors, sensing voltage may be influenced by the gradation which is indicated by the display panel just before the sensing time. As a result, even if the sensed characteristic value of the driving transistor is compensated, there is a problem like a residual image.

Various aspects of the present disclosure provide a display device able to sense characteristics of driving transistors disposed in subpixels of a display panel and compensate for deterioration.

Also provided are a method of sensing characteristic value of circuit element and display device using it, able to accurately sense and compensate the characteristics of driving transistors by reducing the residual image in the display panel before sensing the characteristics of driving transistors.

According one aspect, a display device may comprise a display panel including a plurality of gate lines, a plurality of data lines, and a plurality of subpixels, a gate driver circuit driving the plurality of gate lines, a data driver circuit driving the plurality of data lines, and a timing controller controlling signals applied to the gate driver circuit and the data driver circuit, wherein the timing controller initializes a state of a driving transistor by controlling a data voltage applied to the display panel from the data driver circuit in a sensing period for sensing a characteristic value of the driving transistor in the subpixel.

Each of the plurality of subpixels may comprise an organic light-emitting diode, a driving transistor driving the organic light-emitting diode, a switching transistor electrically connected between a gate node of the driving transistor and a data line among the plurality of data lines, a sensing transistor electrically connected between a source node or a drain node of the driving transistor and a reference voltage line, and a storage capacitor electrically connected between a gate node and a source node or a drain node of the switching transistor.

The sensing period for sensing the characteristic value of the driving transistor may comprise an initializing period in which a data voltage-for-sensing is supplied to the subpixel to be sensed through the data line, and a reference voltage-for-sensing is supplied to the subpixel to be sensed through the reference voltage line, a tracking period in which a voltage of the reference voltage line is increased in response to the reference voltage-for-sensing being blocked, and a sampling period in which a current flowing through the reference voltage line is sensed.

The timing controller may control the data voltage applied to the display panel to a first initializing voltage and a second initializing voltage in the initializing period to swing the gate node-source node voltage of the driving transistor between a positive value and a negative value.

The reference voltage-for-sensing may have a positive level in the initializing period.

The display device may further comprise a deterioration sensing circuit for sensing a characteristic value of the driving transistor.

The deterioration sensing circuit may comprise an amplifier in which an inverting input terminal is electrically connected to a reference voltage line and a non-inverting input terminal is supplied with a reference voltage-for-comparing, a feedback capacitor electrically connected between the inverting input terminal and an output terminal of the amplifier, an initializing switch electrically connected to the feedback capacitor, and a sampling switch electrically connected to the output terminal of the amplifier.

The initializing switch may be in a turn-off state and the sampling switch may be in a turn-on state during the sampling period.

According to another aspect, provided is a method of sensing a characteristic value of a circuit element in a display panel comprising a plurality of data lines, a plurality of gate lines, a plurality of subpixels aligned in intersected areas of the plurality of data lines and the plurality of gate lines to drive a light-emitting element to emit light via driving transistors, a plurality of reference voltage lines, a data driver circuit driving the plurality of data lines, a gate driver circuit driving the plurality of gate lines, and a timing controller controlling signals applied to the gate driver circuit and the data driver circuit, the method comprising: in an initializing period, supplying a data voltage-for-sensing to the subpixel to be sensed through the data line, and supplying a reference voltage-for-sensing to the subpixel to be sensed through the reference voltage line; in a tracking period, increasing a voltage of the reference voltage line in response to the reference voltage-for-sensing being blocked; and in a sampling period, sensing a current flowing through the reference voltage line, wherein the timing controller controls the data voltage applied to the display panel to a first initializing voltage and a second initializing voltage in the initializing period to swing the gate node-source node voltage of the driving transistor between a positive value and a negative value.

The reference voltage-for-sensing may have a positive level in the initializing period.

The display panel may further comprise an amplifier in which an inverting input terminal is electrically connected to a reference voltage line and a non-inverting input terminal is supplied with a reference voltage-for-comparing, a feedback capacitor electrically connected between the inverting input terminal and an output terminal of the amplifier, an initializing switch electrically connected to the feedback capacitor, and a sampling switch electrically connected to the output terminal of the amplifier, wherein the initializing switch is in the turn-off state and the sampling switch is in the turn-on state during the sampling period.

According to one or more embodiments, it is possible to accurately sense and effectively compensate the characteristics of driving transistors by sensing the change of capacitance charged from current through a storage capacitor of the driving transistor disposed in each subpixels SP.

According to one or more embodiments, it is possible to accurately sense and compensate the characteristics of driving transistors by reducing by reducing the residual image in the display panel before sensing the characteristics of driving transistors.

According to one or more embodiments, it is possible to accurately sense and compensate the characteristics of driving transistors by a simple signal processing operation to fluctuate the data voltage before sensing the characteristics of driving transistors.

BRIEF DESCRIPTION OF THE SEVERAL VIEWS OF THE DRAWINGS

The above and other objects, features, and advantages of the present disclosure will be more clearly understood from the following detailed description, taken in conjunction with the accompanying drawings, in which.

DETAILED DESCRIPTION

Hereinafter, various embodiments will be described in detail with reference to the drawings. In adding reference number to the elements of the drawings, the same elements may have the same reference number as possible even if they are displayed on different drawings. In the following description of the present disclosure, detailed descriptions of known functions and components incorporated into the present disclosure will be omitted in the case that the subject matter of the present disclosure may be rendered unclear thereby.

It will also be understood that, while terms, such as "first," "second," "A," "B," "(a)," and "(b)," may be used herein to describe various elements, such terms are merely used to distinguish one element from other elements. The substance, sequence, order, or number of such elements is not limited by these terms. It will be understood that when an element is referred to as being "connected," "coupled," or "linked" to another element, not only can it be "directly connected, coupled, or linked" to the other element, but it can also be "indirectly connected, coupled, or linked" to the other element via an "intervening" element.

Figure 1:
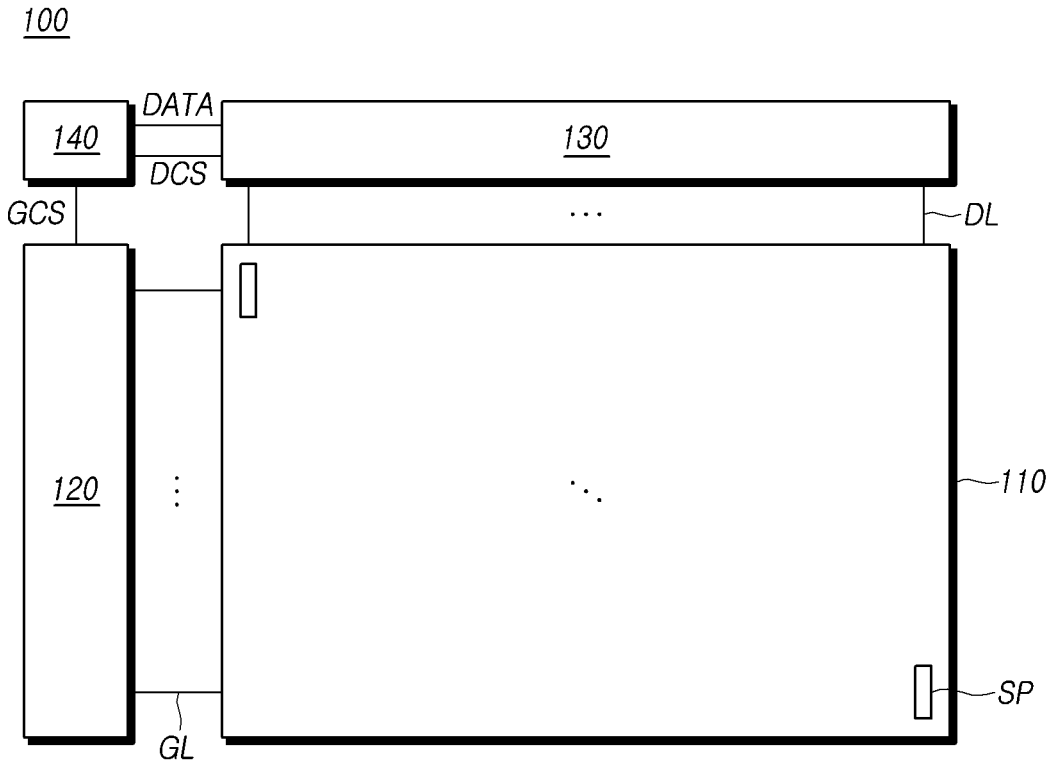
FIG. 1 illustrates a schematic diagram of a display device according to one or more embodiments.

FIG. 1 illustrates a schematic diagram of a display device according to one or more embodiments.

Referring to FIG. 1, the display device 100 according to one or more embodiments may include a display panel 110 in which a plurality of subpixels SP are aligned in rows and columns, a gate driver circuit 120 and a data driver circuit 130 for driving the display panel 110, and a timing controller 140 for controlling the gate driver circuit 120 and the data driver circuit 130.

In the display panel 110, a plurality of gate lines GL and a plurality of data lines DL are disposed, and a plurality of subpixels SP are aligned in adjacent areas in which the plurality of gate lines GL overlap the plurality of data lines DL. For example, in a display device having a resolution of 2,160×3,840, that is, 2,160 gate lines GL and 3,840 data lines DL may be provided, and a plurality of subpixels SP may be aligned in adjacent areas in which the plurality of gate lines GL overlap the plurality of data lines DL.

The gate driver circuit 120 is controlled by the timing controller 140, and controls the driving timing of the plurality of subpixels SP by sequentially supplying scan signals SCAN to the plurality of gate lines GL disposed in the display panel 110. In the display device 100 having a resolution of 2,160×3,840, sequentially supplying the scan signals to the 2,160 gate lines GL from the first gate line GL1 to the 2,160th gate line GL2,160 may be referred to as 2,160-phase driving. Otherwise, sequentially supplying the scan signals to every four gate lines, as in a case in which the scan signals are supplied sequentially from first gate line GL1 to fourth gate lines GL4, and then are supplied sequentially from fifth gate line GL5 to eighth gate line GL8, is referred to as 4-phase driving. As described above, a case in which the scan signals are supplied sequentially to every N number of gate lines may be referred as N-phase driving.

The gate driver circuit 120 may include one or more gate driver integrated circuits (GDIC), which may be disposed on one side or both sides of the display panel 110 depending on the driving method. Alternatively, the gate driver circuit 120 may be implemented in a gate-in-panel (GIP) structure embedded in a bezel area of the display panel 110.

The data driver circuit 130 receives image data DATA from the timing controller 140, and converts the received image data into an analog data voltage Vdata. Afterwards, the data driver circuit 130 supplies the data voltage Vdata to each of the data lines DL at points in time at which the scan signal is applied through the gate lines GL, so that each of the subpixels SP connected to the data lines DL emits light with a corresponding luminance in response to the data voltage Vdata.

Likewise, the data driver circuit 130 may include one or more source driver integrated circuits (SDICs). Each of the source driver Integrated circuits SDICs may be connected to a bonding pad of the display panel 110 by a tape automated bonding (TAB) or a chip on glass (COG), or may be directly mounted on the display panel 110. In some cases, each of the source driver integrated circuits SDIC may be integrated with the display panel 110. In addition, each of the source driver integrated circuits SDICs may be implemented with a chip on film (COF) structure. In this case, the source driver integrated circuit SDIC may be mounted on circuit films to be electrically connected to the data lines DL in the display panel 110 via the circuit films.

The timing controller 140 supplies various control signals to the gate driver circuit 120 and the data driver circuit 130, and controls the operations of the gate driver circuit 120 and the data driver circuit 130. That is, the timing controller 140 controls the gate driver circuit 120 to supply the scan signal SCAN in response to a time realized by respective frames, and on the other hand, converts data input from an external source into image data having a data signal format readable by the data driver circuit 130, and supplies the converted image data to the data driver circuit 130.

Here, the timing controller 140 receives various timing signals, including a vertical synchronization signal Vsync, a horizontal synchronization signal Hsync, a data enable signal DE, a clock signal CLK, and the like, from an external source (e.g., a host system). Accordingly, the timing controller 140 generates control signals using the various timing signals received from the external source, and supplies the control signals to the gate driver circuit 120 and the data driver circuit 130.

For example, the timing controller 140 supplies various gate control signals, including a gate start pulse GSP, a gate shift clock GSC, a gate output enable GOE, and the like, to control the gate driver circuit 120. Here, the gate start pulse GSP is used to control the start timing of one or more gate driver integrated circuits GDICs of the gate driver circuit 120. In addition, the gate shift clock GSC is a clock signal commonly supplied to the one or more gate driver integrated circuits GDICs to control the shift timing of the scan signal. The gate output enable GOE designates timing information of the one or more gate driver integrated circuits GDICs.

In addition, the timing controller 140 supplies various data control signals DCSs, including a source start pulse SSP signal, a source sampling clock SSC, a source output enable SOE, and the like, to control the data driver circuit 130. Here, the source start pulse SSP is used to control the start timing for the data sampling of one or more source driver integrated circuits SDICs of the data driver circuit 130. The source sampling clock SSC is a clock signal controlling the sampling timing of data in each of the source driver integrated circuits SDICs. The source output enable SOE controls the output timing of the data driver circuit 130.

The display device 100 may further include a power management integrated circuit PMIC supplying various forms of voltage or current to the display panel 110, the gate driver circuit 120, the data driver circuit 130, and the like, or controlling various forms of voltage or current to be supplied to the same.

The subpixels SP are located adjacent to points at which the gate lines GL overlap with the data lines DL, and a light-emitting element may be disposed in each of the subpixels SP. For example, the organic light-emitting display device 100 includes a light-emitting element, such as a light-emitting diode (LED) or an organic light-emitting diode (OLED) in each of the subpixels SP, and may display an image by controlling current flowing through the light-emitting elements in response to the data voltage Vdata.

Figure 2:
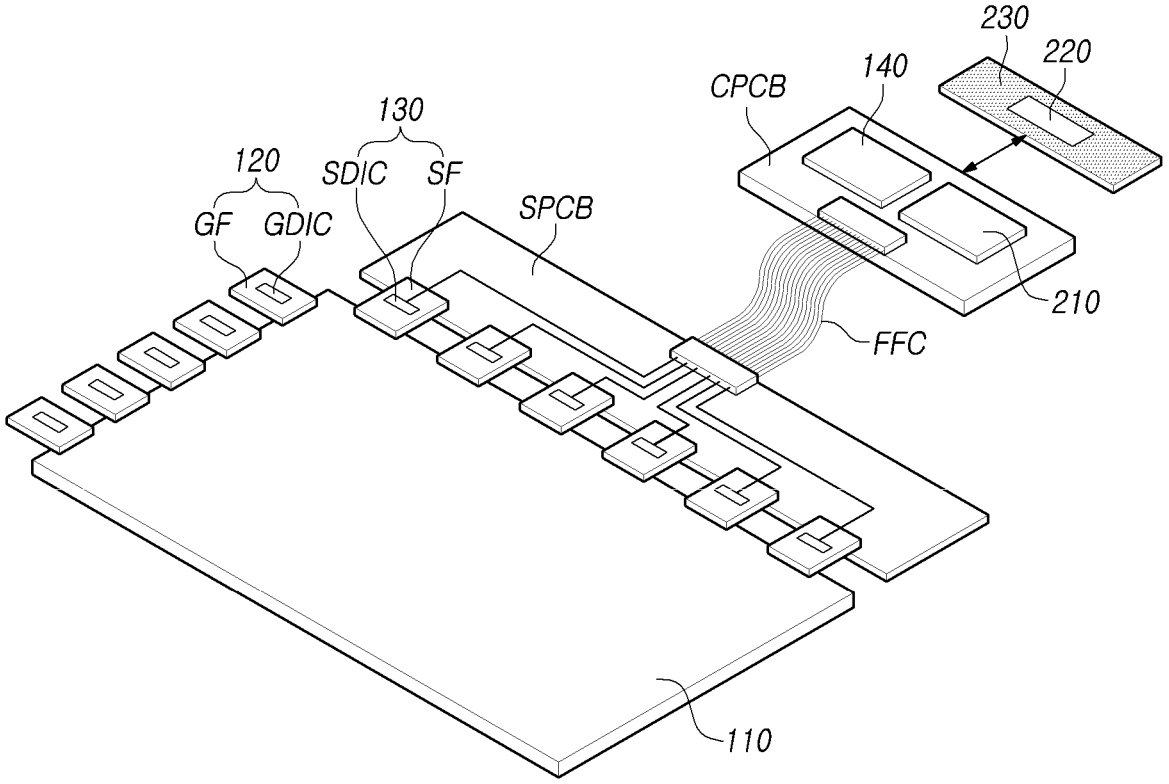
FIG. 2 illustrates a system of the display device according to one or more embodiments.

FIG. 2 illustrates a system of the display device according to one or more embodiments.

In the display device 100 illustrated in FIG. 2, each of the source driver integrated circuits SDICs of the data driver circuit 130 is implemented with a COF among various structures, such as a TAB, a COG, and a COF, and the gate driver circuit 120 is implemented with a GIP among various structures, such as a TAB, a COG, a COF, and a GIP.

The plurality of source driver integrated circuits SDICs of the data driver circuit 130 may be mounted on a source-side circuit films SF, respectively. One portion of the source-side circuit film SF may be electrically connected to the display panel 110. In addition, electrical lines may be disposed in the top portion of the source-side circuit films SF to electrically connect the source driver integrated circuits SDICs and the display panel 110.

The display device 100 may include at least one source printed circuit board SPCB in order to connect the plurality of source driver integrated circuits SDICs to other devices by electrical circuit, and a control printed circuit board CPCB in order to mount various control components and electric devices.

The other portion of the source-side circuit film SF, on which the source driver integrated circuit SDIC is mounted, may be connected to the at least one source printed circuit board SPCB. That is, one portion of source-side circuit film SF, on which the source driver integrated circuit SDIC is mounted, may be electrically connected to the display panel 110, and the other portion of the source-side circuit film SF may be electrically connected to the source printed circuit board SPCB.

The timing controller 140 and a power management integrated circuit PMIC 210 may be mounted on the control printed circuit board CPCB. The timing controller 140 may control the operations of the data driver circuit 130 and the gate driver circuit 120. The power management integrated circuit PMIC 210 may supply various forms of voltage or current including a driving voltage, to the data driver circuit 130, the gate driver circuit 120, and the like, or may control the voltage or current to be supplied to the same.

At least one source printed circuit board SPCB and the control printed circuit board CPCB may have circuitry connection by at least one connecting member. The connecting member may be, for example, a flexible printed circuit FPC, a flexible flat cable FFC, or the like. At least one source printed circuit board SPCB and the control printed circuit board CPCB may be integrated into a single printed circuit board.

The display device 100 may further include a set board 230 electrically connected to the control printed circuit board CPCB. The set board 230 may also be referred to as a power board. A main power management circuit M-PMC 220 managing overall power of the display device 100 may be located on the set board 230. The main power management circuit M-PMC 220 may be coupled to the power management integrated circuit PMIC 210.

In the display device 100 having the above-described configuration, a driving voltage EVDD is generated by the set board 230 to be transferred to the power management integrated circuit 210. The power management integrated circuit 210 transfers the driving voltage EVDD, which is used during an image driving period or a sensing period, to the source printed circuit board SPCB through a flexible printed circuit FPC or a flexible flat cable FFC. The driving voltage EVDD, transferred to the source printed circuit board SPCB, is supplied to emit or sense a specific subpixel SP in the display panel 110 via the source driver integrated circuits SDICs.

Each of the subpixels SP aligned in the display panel 110 of the display device 100 may include a light-emitting element, such as an organic light-emitting diode (OLED), and circuit elements, such as a driving transistor to drive it.

The type and number of circuit elements forming each of the subpixels SP may be variously determined depending on the function, the design, or the like.

Figure 3:
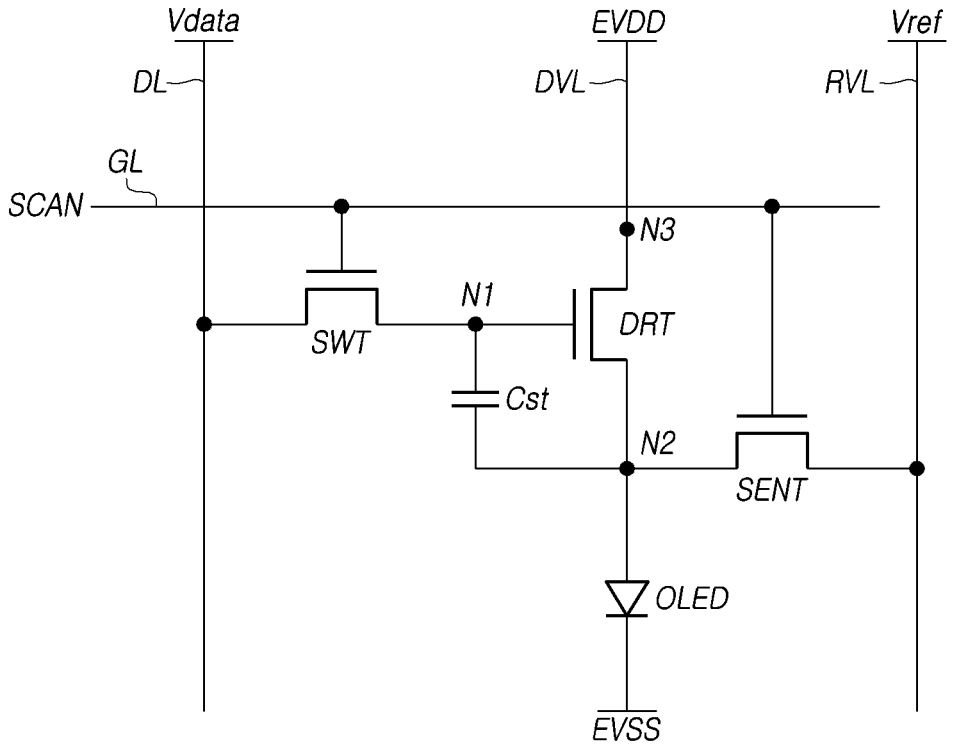
FIG. 3 illustrates a circuit structure of subpixels aligned in the display device according to one or more embodiments.

FIG. 3 illustrates a circuit structure of subpixels aligned in the display device according to one or more embodiments.

Referring to FIG. 3, each of the subpixels SP aligned in the display device 100 according to one or more embodiments may include one or more transistors, a capacitor, and an organic light-emitting diode OLED as a light-emitting element.

For example, the subpixel SP may include a driving transistor DRT, a switching transistor SWT, a sensing transistor SENT, a storage capacitor Cst, and the organic light-emitting diode OLED.

The driving transistor DRT may have a first node N1, a second node N2, and a third node N3. The first node N1 of the driving transistor DRT may be a gate node to supply a data voltage Vdata through a data line DL when the switching transistor SWT is turned on. The second node N2 of the driving transistor DRT may be electrically connected to an anode of the organic light-emitting diode OLED, and may be a drain node or a source node. The third node N3 of the driving transistor DRT may be electrically connected to a driving voltage line DVL in which a driving voltage EVDD is supplied, and may be a source node or a drain node.

Here, the driving voltage EVDD for the image driving may be supplied to the driving voltage line DVL in the image driving period. For example, the driving voltage EVDD for the image driving may be about 27V.

The switching transistor SWT is electrically connected between the first node N1 of the driving transistor DRT and the data line DL, and operates in response to the scan signal SCAN supplied thereto through the gate line GL connected to the gate node. In addition, it controls the operation of the driving transistor DRT by supplying the data voltage Vdata from the data line DL to the gate node of the driving transistor DRT when the switching transistor SWT is turned on.

The sensing transistor SENT is electrically connected between the second node of the driving transistor DRT and a reference voltage line RVL, and operates in response to the scan signal SCAN supplied thereto through the gate line GL connected to the gate node. When the sensing transistor SENT is turned on, a reference voltage-for-sensing Vref from the reference voltage line RVL is supplied to the second node N2 of the driving transistor DRT.

That is, the voltages of the first node N1 and the second node N2 of the driving transistor DRT may be controlled by controlling the switching transistor SWT and the sensing transistor SENT. Consequently, a current for driving the organic light-emitting diode OLED can be supplied.

The switching transistor SWT and the sensing transistor SENT may be connected to a single gate line GL or to different signal lines. Here, it illustrates an exemplary structure of which the switching transistor SWT and the sensing transistor SENT are connected to a single gate line GL. In this case, the switching transistor SWT and the sensing transistor SENT are controlled simultaneously by the scan signal SCAN from the single gate line GL, and thus the aperture ratio of the subpixels SP may be improved.

In addition, the transistors disposed in the subpixels SP may be not only n-type transistors, but also p-type transistors. Herein, it illustrates the exemplary structure of the n-type transistors.

The storage capacitor Cst is electrically connected between the first node N1 and the second node N2 of the driving transistor DRT, and serves to maintain the data voltage Vdata for one frame period.

Such a storage capacitor Cst may be connected between the first node N1 and the third node N3 of the driving transistor DRT depending on the type of the driving transistor DRT. The anode of the organic light-emitting diode OLED may be electrically connected to the second node N2 of the driving transistor DRT, and a base voltage EVSS may be supplied to a cathode of the organic light-emitting diode OLED. Here, the base voltage EVSS may be the ground voltage or a voltage higher or lower than the ground voltage. In addition, the base voltage EVSS may vary depending on the driving condition. For example, the base voltage EVSS during the image driving period may be different from the base voltage EVSS during the sensing period.

The structure of the subpixel SP as described above has three transistors and one capacitor 3T1C. However, this is merely for illustrative purposes, and one or more transistors, or in some cases, one or more capacitors may be further included. In addition, the plurality of subpixels SP may have the same structure, or some of the plurality of subpixels SP may have a different structure from the other subpixels.

The display device 100 according to one or more embodiments may use a method for measuring a current flowing by voltage charged in the storage capacitor Cst during a sensing period for the driving transistor DRT in order to sense the characteristics of the driving transistor DRT like threshold voltage or mobility. Such a method may be referred to as current sensing.

That is, the characteristic value or the change of the characteristic value of the driving transistor DRT in the subpixel SP may be determined by measuring the current flowing by voltage charged in the storage capacitor Cst during the sensing period of the driving transistor DRT. At this time, the reference voltage line RVL may be referred to as a sensing line since the reference voltage line RVL serves not only to supply the reference voltage Vref but also serves as a sensing line for sensing the characteristic value of the driving transistor DRT in the subpixel SP.

More specifically, in the display device 100 according to one or more embodiments, the characteristic value or the change of the characteristic value of the driving transistor DRT may correspond to a difference (e.g., Vdata−Vref) between the voltage of the first node N1 and the voltage of the second node N2 of the driving transistor DRT.

The sensing for the characteristic value of the driving transistor DRT may be performed by, for example, a deterioration sensing circuit included in the data driver circuit 130.

Figure 4:
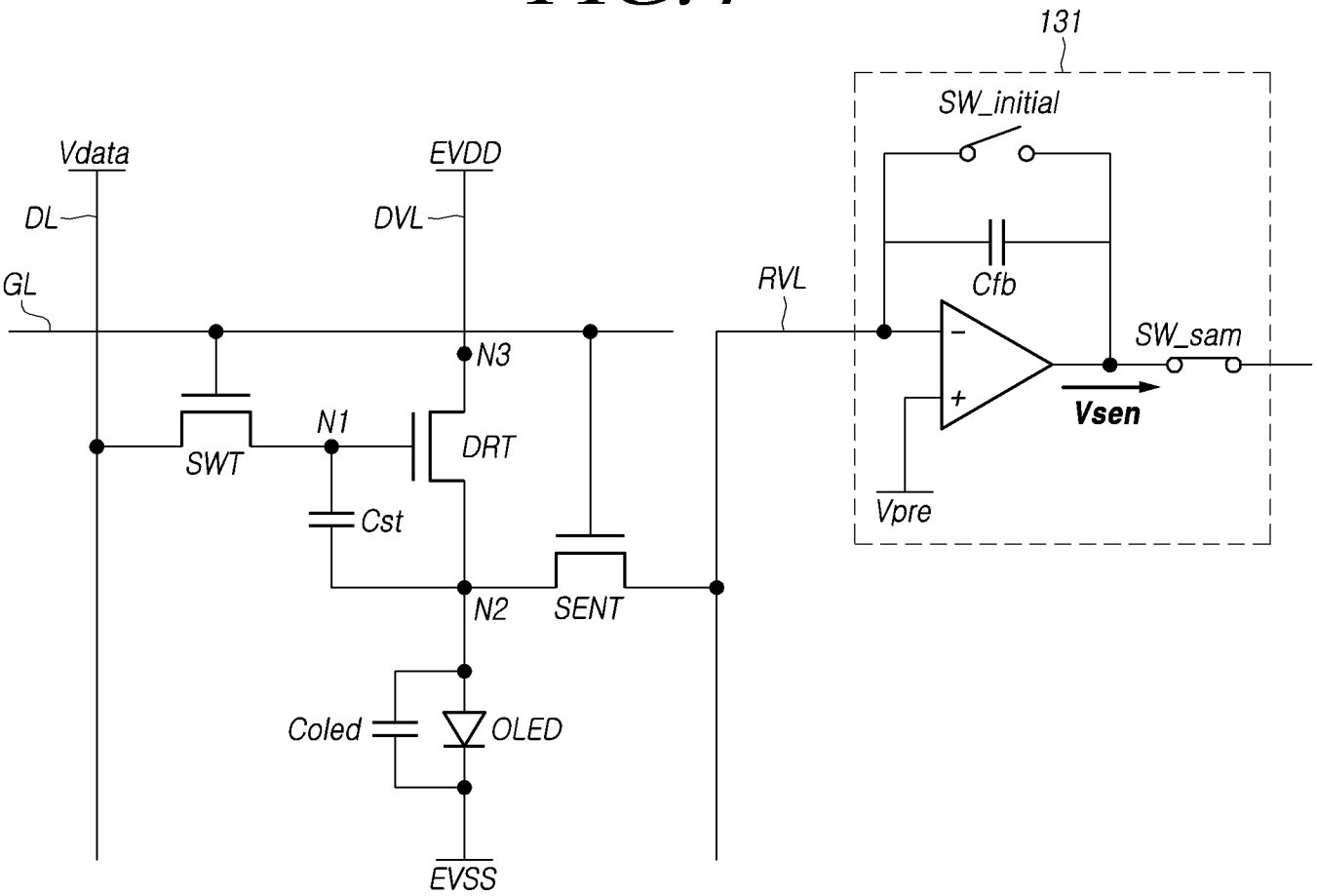
FIG. 4 illustrates a deterioration sensing circuit for sensing characteristics of driving transistors according to one or more embodiments.

FIG. 4 illustrates a deterioration sensing circuit for sensing characteristics of driving transistors according to one or more embodiments.

Referring to FIG. 4, the data driver circuit 130 may supply the data voltage Vdata at the level of the data voltage-for-sensing Vdata_sen through the data line DL in a period for sensing the characteristic value of the driving transistor DRT, and supply the reference voltage-for-sensing Vref through the reference voltage line RVL. At this time, the data voltage-for-sensing Vdata_sen supplied through the data line DL may be about 14V, and the reference voltage-for-sensing Vref supplied through the reference voltage line RVL may be about 4V.

As a result, due to a voltage difference formed between the first node N1 and the second node N2 of the driving transistor DRT, the storage capacitor Cst can be charged. At this time, the driving voltage EVDD supplied through the driving voltage line DVL during the sensing period for the characteristic value of the driving transistor DRT may be equal to or lower than the driving voltage supplied during the image driving period of the display panel.

The deterioration sensing circuit 131 senses the capacitance charged in the storage capacitor Cst of the driving transistor DRT and supplies a sensing voltage Vsen according to the sensed capacitance. The supplied sensing voltage Vsen may be transmitted to the timing controller 140 and the timing controller 140 determines the characteristic value or the change of the characteristic value of the driving transistor DRT from the sensing voltage Vsen. When there is a change in the characteristic value of the driving transistor DRT, the timing controller 140 supplies the compensated data voltage Vdata to the corresponding subpixel SP according to a size of the change. As a result, the subpixel SP may emit the light with luminance corresponding to the compensated data voltage Vdata, thereby reducing luminance non-uniformity.

The deterioration sensing circuit 131 may have various structures, for example, a feedback capacitor Cfb and an amplifier. In this case, it may include an initializing switch SW_initial for initializing the feedback capacitor Cfb and a sampling switch SW_sam for sampling the sensing voltage Vsen.

In the amplifier, the reference voltage-for-comparing Vpre may be applied to the non-inverting input terminal (+), and the inverting input terminal (−) may be connected to the reference voltage line RVL. A feedback capacitor Cfb may be electrically connected between the inverting input terminal (−) and the output terminal of the amplifier.

When the feedback capacitor Cfb is charged by the capacitance in the storage capacitor Cst of the driving transistor DRT, the change of capacitance charged in the storage capacitor Cst may be sensed in accordance with the change in the characteristic value of the driving transistor DRT. At this time, since the amplifier outputs a value in the negative direction as the capacitance charged in the feedback capacitor Cfb increases, the sensing voltage Vsen may be increased by decreasing of the capacitance charged in the storage capacitor Cst due to a change in the characteristic value of the driving transistor DRT.

Meanwhile, the display device 100 according to the one or more embodiments may include a memory MEM stored with a reference sensing voltage in advance, and a compensator for compensating the deviation of the characteristic value by comparing the reference sensing voltage stored in the memory MEM with the sensing voltage measured in the deterioration sensing circuit 131. The compensation value calculated by the compensator may be stored in the memory MEM and the timing controller 140 may change the image data to be supplied to the data driver circuit 130 using the compensation value calculated by the compensator, and output the changed image data to the data driver circuit 130.

Accordingly, the data driver circuit 130 outputs the changed image data to the corresponding data line DL, so that the deviation of the characteristic value (e.g., the deviation of threshold voltage, the deviation of the mobility) for the driving transistor DRT in the corresponding subpixel SP may be compensated.

Figure 5:
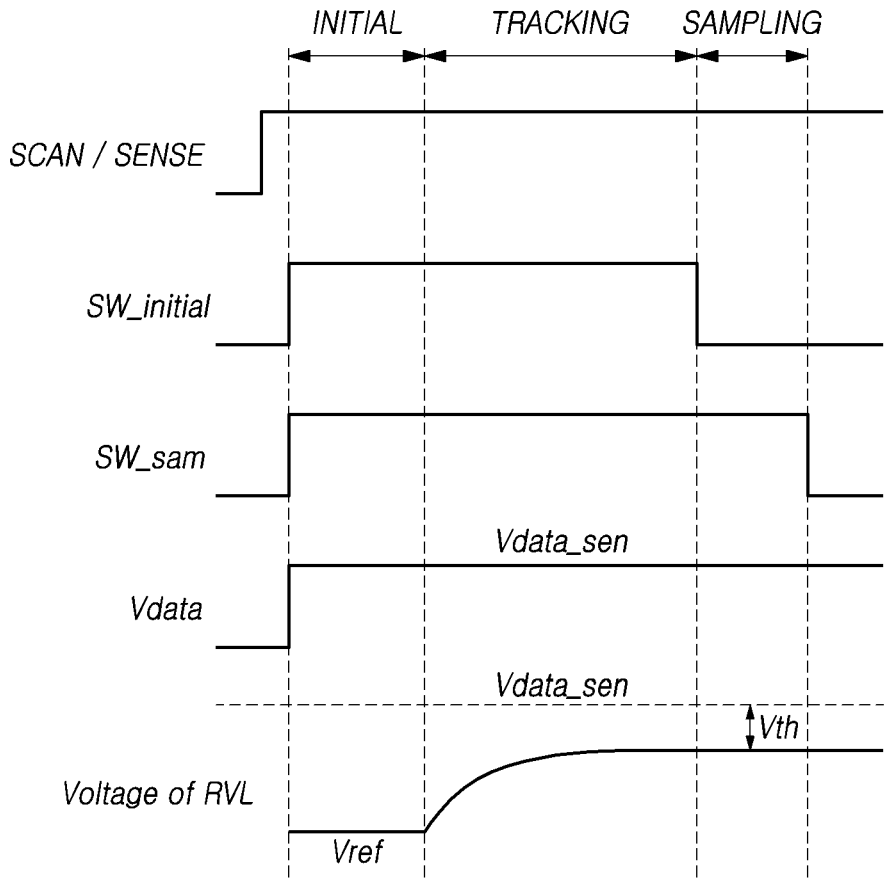
FIG. 5 illustrates a signal timing diagram for sensing threshold voltage of the driving transistor in the display device according to one or more embodiments.

FIG. 5 illustrates a signal timing diagram for sensing threshold voltage of the driving transistor in the display device according to one or more embodiments.

Referring to FIG. 5, the threshold voltage sensing process of the driving transistor DRT may be comprised of an initializing period INITIAL, a tracking period TRACKING, and a sampling period SAMPLING. Since the switching transistor SWT and the sensing transistor SENT are generally turned on and turned off for sensing the threshold voltage of the driving transistor DRT, the scan signal SCAN and the sense signal SENSE may be applied simultaneously through one gate line GL.

The initializing period INITIAL is a period to charge the second node N2 of the driving transistor DRT with the reference voltage-for-sensing Vref for sensing the characteristic value of the driving transistor DRT, and the scan signal SCAN and the sense signal SENSE may be applied with a high level through the gate line GL.

The tracking period TRACKING is a period to charge the storage capacitor Cst after completing the charge for the second node N2 of the driving transistor DRT.

The sampling period SAMPLING is a period to detect the current flowing by the capacitance charged in the storage capacitor Cst via the deterioration sensing circuit 131 after the storage capacitor Cst of the driving transistor DRT is charged.

In the initializing period INITIAL, the switching transistor SWT is turned on by the scan signal SCAN/sense signal SENSE with turn-on level. As a result, the first node N1 of the driving transistor DRT is initialized to the data voltage-for-sensing Vdata_sen for sensing the threshold voltage. In addition, the scan signal SCAN/sense signal SENSE with a turn-on level cause the sensing transistor SENT to be turned on. In this state, the second node N2 of the driving transistor DRT is initialized to the reference voltage-for-sensing Vref by the reference voltage-for-sensing Vref applied through the reference voltage line RVL.

The tracking period TRACKING is a period to track the threshold voltage of the driving transistor DRT. In the tracking period TRACKING, the voltage of the second node N2 of the driving transistor DRT which indicates the threshold voltage of the driving transistor DRT is tracked. In the tracking period TRACKING, the switching transistor SWT and the sensing transistor SENT are maintained to turn-on level and the reference voltage-for-sensing Vref applied through the reference voltage line RVL is blocked (e.g., the reference voltage-for-sensing Vref is no longer applied to the reference voltage line RVL). Consequently, the second node N2 of the driving transistor DRT is floated, so that the voltage of the second node N2 of the driving transistor DRT is increased from the reference voltage-for-sensing Vref. At this time, since the sensing transistor SENT is turned on, the rise of the voltage at the second node N2 of the driving transistor DRT leads to the rise of the voltage at the reference voltage line RVL.

The feedback capacitor Cfb is not charged when the initializing switch SW_initial of the deterioration sensing circuit 131 is turned on.

In this process, the voltage at the second node N2 of the driving transistor DRT rises and becomes a saturation state. The saturation voltage at the second node N2 of the driving transistor DRT corresponds to the difference (Vdata_sen−Vth) between the data voltage-for-sensing Vdata_sen for sensing the threshold voltage and the threshold voltage Vth of the driving transistor DRT.

In the sampling period SAMPLING, the scan signal SCAN/sense signal SENSE with a high level are applied to the gate line GL, the initializing switch SW_initial of the deterioration sensing circuit 131 is turned off, and the sampling switch SW_sam maintains the turn-on state. At this time, the capacitance charged in the storage capacitor Cst of the drive transistor DRT is supplied to the feedback capacitor Cfb of the deterioration sensing circuit 131, since the initializing switch SW_initial of the deterioration sensing circuit 131 is in the turn-off state.

The amplifier of the deterioration sensing circuit 131 outputs the sensing voltage Vsen according to the capacitance charged in the feedback capacitor Cfb. The larger the capacitance charged in the feedback capacitor Cfb is, the further the sensing voltage Vsen goes forward to (−) direction. Therefore, when the capacitance charged in the storage capacitor Cst decreases due to the deterioration of the driving transistor DRT, the capacitance charged in the feedback capacitor Cfb decreases, and as a result, the amplifier outputs a higher sensing voltage Vsen than before it deteriorated. The deterioration of the driving transistor DRT may be sensed by using the value of the sensing voltage Vsen outputted from the amplifier.

Figure 6:
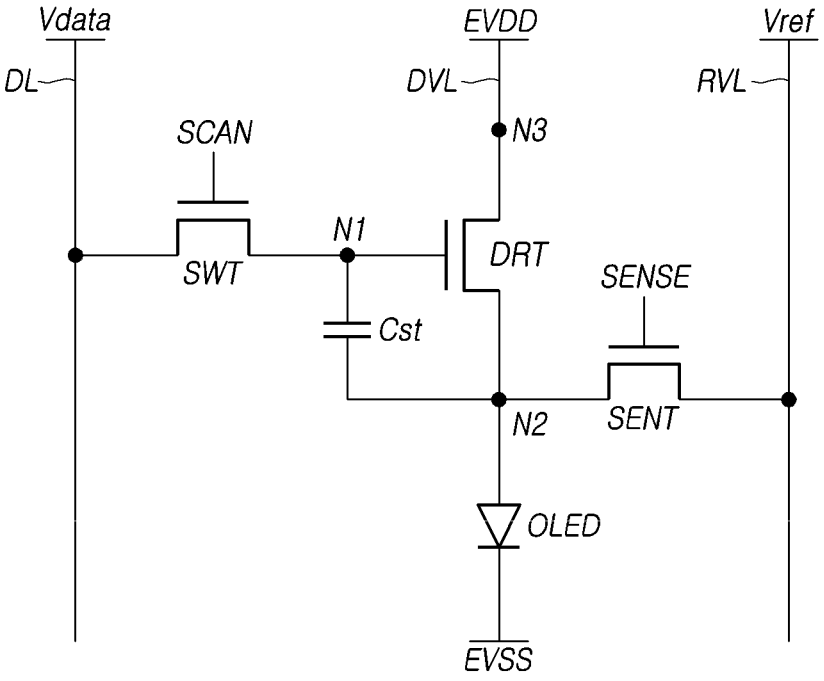
FIG. 6 illustrates a circuit structure of subpixels, in which gate nodes of a switching transistor and a sensing transistor are connected to different signal line in the display device according to one or more embodiments.

FIG. 6 illustrates a circuit structure of subpixels, in which gate nodes of a switching transistor and a sensing transistor are connected to different signal line in the display device according to one or more embodiments.

Referring to FIG. 6, the switching transistor SWT may be on-off controlled by a scan signal SCAN applied to a gate node through a corresponding gate line. The sensing transistor SENT may be on-off controlled by a sense signal SENSE, different from the scan signal SCAN, applied to a gate node through the corresponding gate line.

When the scan signal SCAN for controlling the switching transistor SWT is different from the sense signal SENSE for controlling the sensing transistor SENT, the switching transistor SWT and the sensing transistor SENT are controlled independently. The current driving capability (mobility) of the driving transistor DRT may be sensed using this.

Figure 7:
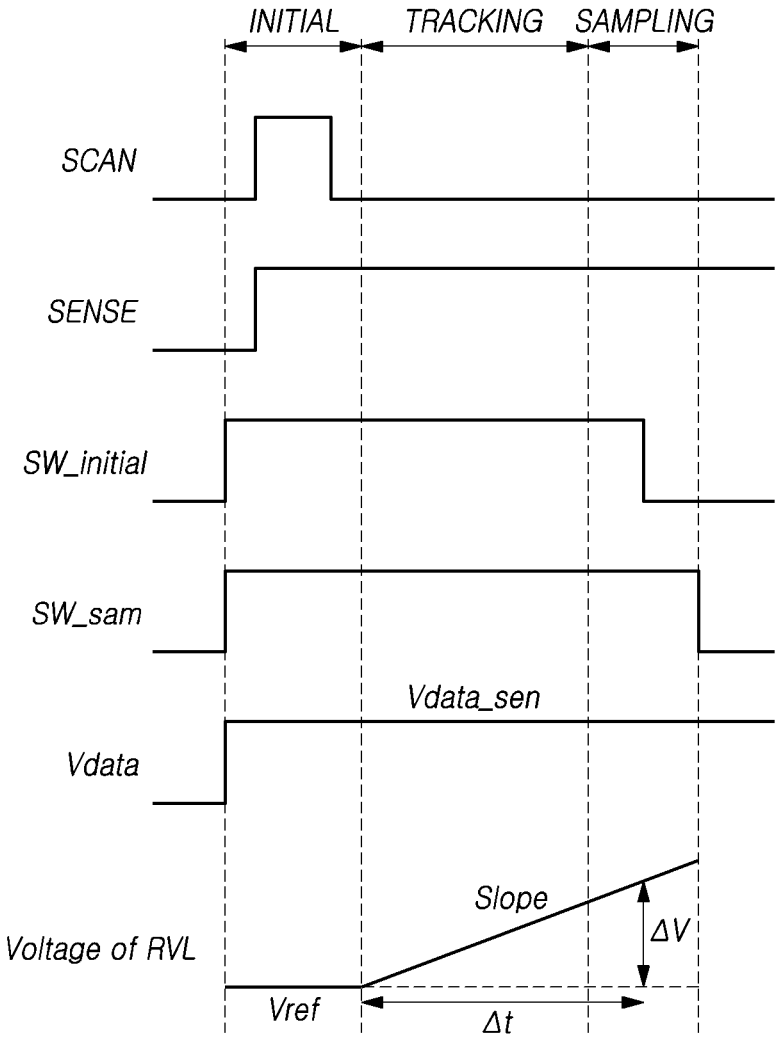
FIG. 7 illustrates a signal timing diagram for sensing the mobility of the driving transistor in the display device according to one or more embodiments.

FIG. 7 illustrates a signal timing diagram for sensing the mobility of the driving transistor in the display device according to one or more embodiments.

Referring to FIG. 7, the mobility sensing process of the driving transistor DRT in the display device 100 according to one or more embodiments may be comprised of an initializing period INITIAL, a tracking period TRACKING, and a sampling period SAMPLING like the threshold voltage sensing process.

In the initializing period INITIAL, the switching transistor SWT is turned on by scan signal SCAN with the turn-on level, and the first node N1 of the driving transistor DRT is initialized to the data voltage Vdata for sensing the mobility. In addition, a sense signal SENSE with a turn-on level causes the sensing transistor SENT to be turned on. In this state, the second node N2 of the driving transistor DRT is initialized to the reference voltage-for-sensing Vref.

The tracking period TRACKING is a period to track the mobility of the driving transistor DRT. The mobility of the driving transistor DRT may indicate current driving ability of the driving transistor DRT. In the tracking period TRACKING, the voltage at the second node N2 of the driving transistor DRT for determining the mobility of the driving transistor DRT is tracked.

In the tracking period TRACKING, the switching transistor SWT is turned off by the scan signal SCAN with a turn-off level, and a switch to receive the reference voltage-for-sensing Vref is blocked. Consequently, both the first node N1 and the second node N2 of the driving transistor DRT are floated, so that both the voltage at the first node N1 and the voltage at the second node N2 of the driving transistor DRT are increased. In particular, since the voltage at the second node N2 of the driving transistor DRT was initialized to the reference voltage-for-sensing Vref, it starts to increase from the reference voltage-for-sensing Vref. At this time, an increase of the voltage at the second node N2 of the driving transistor DRT causes an increase of the voltage in the reference voltage line RVL, since the sensing transistor SENT is in the turned-on state.

In the sampling period SAMPLING, the initializing switch SW_initial of the deterioration sensing circuit 131 is turned on when a predetermined time Δt has passed from a point in time at which the voltage at the second node N2 of the driving transistor DRT started to increase. At this time, the feedback capacitor Cfb is not charged before the initializing switch SW_initial of the deterioration sensing circuit 131 is turned off, but the feedback capacitor Cfb of the deterioration sensing circuit 131 is charged from the capacitance of the storage capacitor Cst of the driving transistor DRT while the initializing switch SW_initial of the deterioration sensing circuit 131 is turned off and the sampling switch SW_sam is turned on.

At this time, the amplifier outputs the sensing voltage Vsen according to the capacitance charged in the feedback capacitor Cfb. The sensing voltage Vsen may correspond to a voltage (Vref+ΔV) raised from the reference voltage-for-sensing Vref by a constant voltage ΔV. The mobility of the driving transistor DRT may be determined by using the measured sensing voltage (Vref+ΔV), reference voltage-for-sensing Vref, which is already known, and the passed time ΔT.

That is, the mobility of the driving transistor DRT is proportional to the voltage variation per unit time ΔV/Δt of the reference voltage line RVL through the tracking period TRACKING and the sampling period SAMPLING. Therefore, the mobility of the driving transistor DRT is proportional to the slope of the voltage in the reference voltage line RVL.

The compensator connected to the deterioration sensing circuit 131 compares the mobility determined with respect to the driving transistor DRT to the reference mobility or mobility of the other driving transistor DRT, and may compensate the deviation of the mobility among the driving transistors DRTs. Here, the compensation for the deviation of the mobility may be performed through a logic process or the like that multiplies the image data by the compensation value.

Although the structure of each of the subpixels SP has been described as having the 3T1C structure comprised of three transistors and one capacitor by way of example, this is merely for illustrative purposes, and one or more transistors, or in some cases, one or more capacitors may be further included. In addition, the plurality of subpixels SP may have the same structure, or some of the plurality of subpixels SP may have a different structure from the remaining subpixels.

In the process of sensing the deterioration of the driving transistor DRT constituting the subpixel of the display device 100, the voltage at the gate node N1 of the driving transistor DRT rises and falls continuously according to the data voltage Vdata or the storage capacitor Cst. At this time, in the case where the voltage applied to the gate node of the driving transistor DRT rises or falls like the other transistors, the current flowing to the driving transistor DRT varies due to hysteresis.

Figure 8:
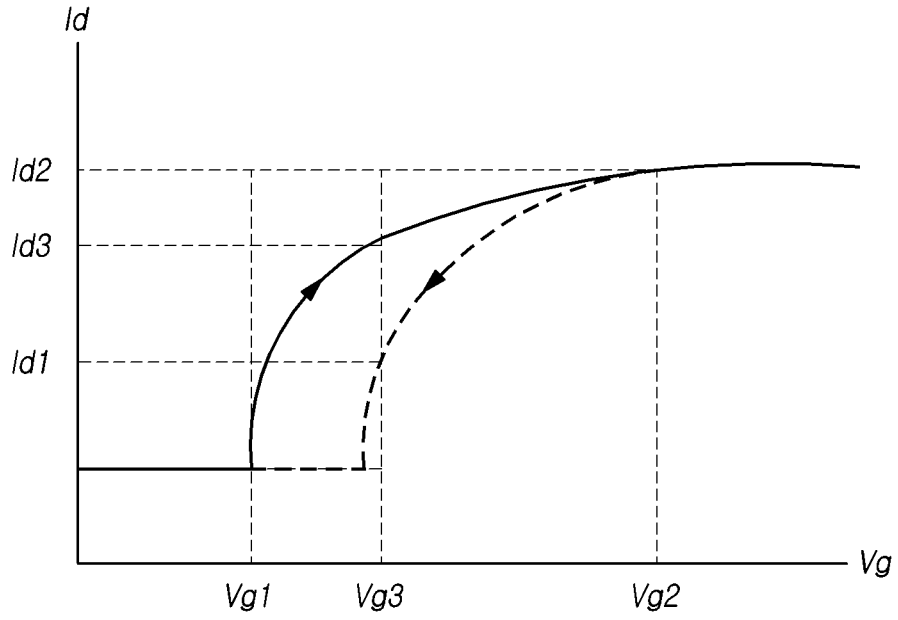
FIG. 8 illustrates a graph of current variation due to the hysteresis of the driving transistor in the display device according to one or more embodiments.

FIG. 8 illustrates a graph of current variation due to the hysteresis of the driving transistor in the display device according to one or more embodiments.

Referring to FIG. 8, the voltage Vg applied to the gate node of the driving transistor DRT may rise or fall in the driving period or sensing period of the display panel. At this time, the driving transistor DRT may have a different turn-on time between the rising and falling of the voltage Vg applied to the gate node of the driving transistor DRT. For example, when the gate voltage Vg of the driving transistor DRT rises in the turn-off state, a current begins to flow in the driving transistor DRT from the time of the gate voltage Vg with the Vg1 level and a turn-on current Id2 may flow at a time of the gate voltage Vg with the Vg2 level.

On the other hand, when the gate voltage Vg of the driving transistor DRT falls in the turn-on state, the current begins to fall in the driving transistor DRT from the time of the gate voltage Vg with the Vg2 level, and the current may be completely blocked at a time of the gate voltage Vg with the Vg3 level.

Accordingly, when the voltage Vg applied to the gate node of the driving transistor DRT rises from the turn-off state to the turn-on state, the current flowing in the driving transistor DRT may have Id3 level at the time the voltage of the gate node becomes to be Vg3 level. On the other hand, when the voltage Vg applied to the gate node of the driving transistor DRT falls from the turn-on state to the turn-off state, the current flowing in the driving transistor DRT may have Id1 level at the time the voltage of the gate node becomes to be Vg3 level.

This hysteresis phenomenon of the driving transistor DRT causes a variation of the current magnitude flowing in the driving transistor DRT at a specific time, and as a result, it is possible to cause an error in the compensation of the residual image by the current sensing due to variation of the current flowing from the storage capacitor Cst to the deterioration sensing circuit 131.

Figure 9:
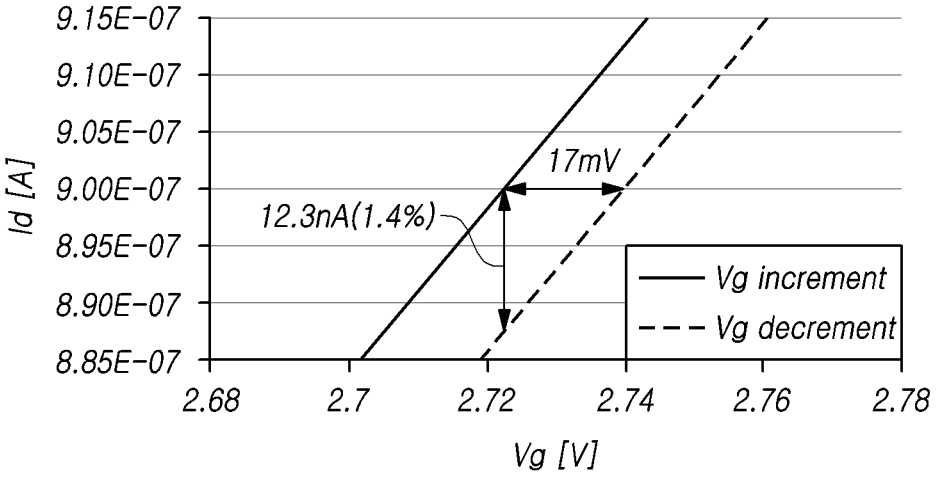
FIG. 9 illustrates a result of experimentally measuring the rate of current variation due to the hysteresis of the driving transistor in the display device.

FIG. 9 illustrates a result of experimentally measuring the rate of current variation due to the hysteresis of the driving transistor in the display device.

Referring to FIG. 9, even if the gate voltage Vg of the driving transistor DRT is at the same level, the current Id may have different values with a gap of 12.3 nA between the processes of the gate voltage Vg rising and falling. Moreover, even if the current flowing in the driving transistor DRT has a value of about 900 nA, it can be seen the difference with a gap of 17 mV between the level in the process of the gate voltage Vg rising and the level in the process of the gate voltage Vg falling.

Accordingly, it difficult to accurately detect the degree for the deterioration of the driving transistor DRT due to the variation of the current value measured by the deterioration sensing circuit 131 according to the cases of the voltage Vg at the gate node N1 of the driving transistor DRT rising or falling in the process of sensing the characteristic value of the driving transistor DRT.

Figure 10:
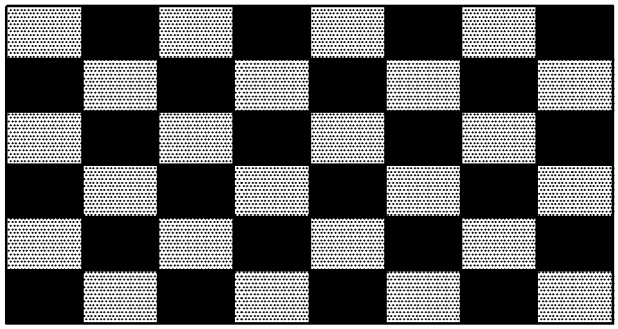
FIG. 10 illustrates an exemplary view showing a residual image due to the hysteresis of the driving transistor in the display panel of the display device according to one or more embodiments.
Figure 10:
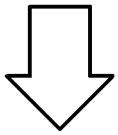
Figure 10:
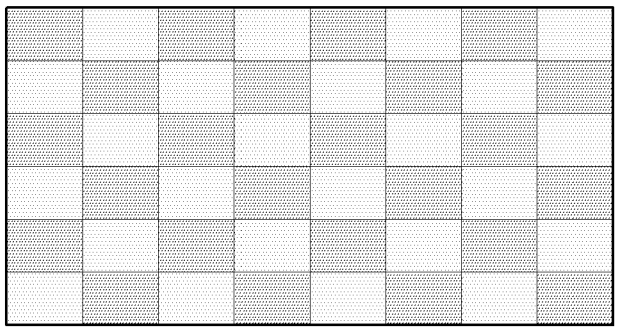

FIG. 10 illustrates an exemplary view showing a residual image due to the hysteresis of the driving transistor in the display panel of the display device according to one or more embodiments.

As illustrated in FIG. 10, the hysteresis of the driving transistor DRT appears as a residual image since it is influenced by gradation remaining in the subpixel SP of the display panel 110 before the characteristic value of the driving transistor DRT is sensed.

As a result, the compensation by sensing the characteristic value of the driving transistor DRT is not accurately performed, and it may be a problem that the gradation of the display panel 110 is blurred.

The display device 100 according to one or more embodiments sets the states for sensing the characteristic value of the driving transistor DRT for reducing or minimizing an effect of the gradation remaining in the subpixel SP before the characteristic value of the driving transistor DRT is sensed.

For this purpose, the states of the driving transistor DRT may be initialized to the same condition to reduce or minimize the influence of the subpixel SP from the previous frame by swing the gate node-source node voltage Vgs of the driving transistor DRT between a positive value and a negative value before the characteristic value of the driving transistor DRT in the display device 100 is sensed.

Figure 11:
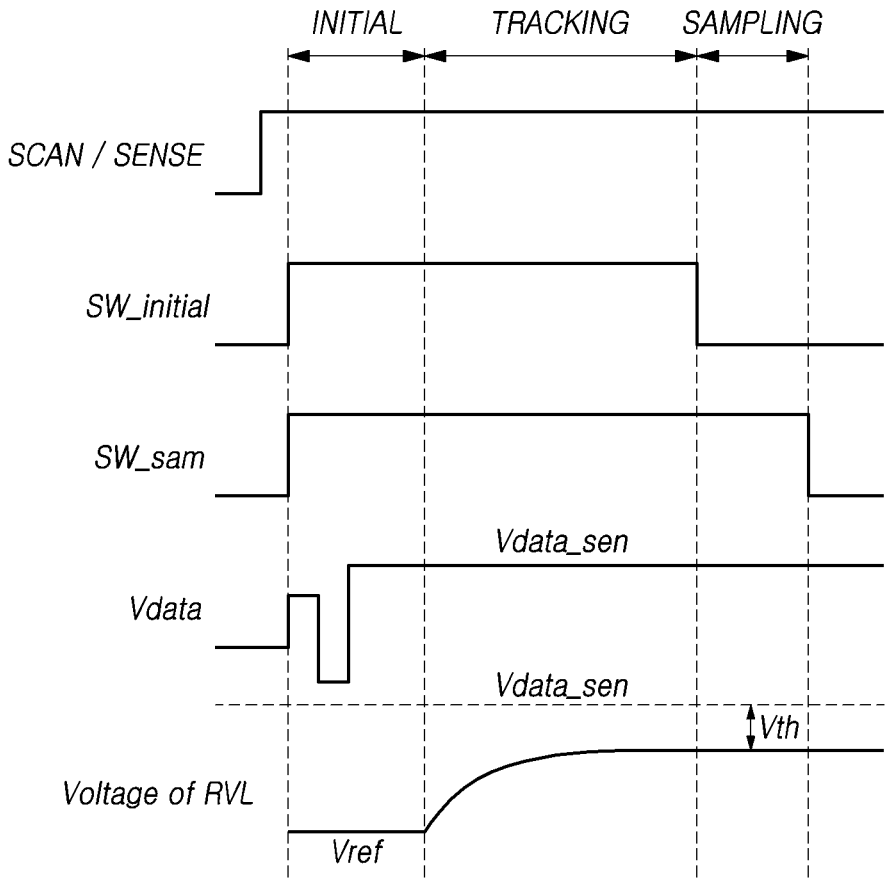
FIG. 11 illustrates a signal timing diagram for sensing the characteristics of the driving transistor in the display device according to one or more embodiments.

FIG. 11 illustrates a signal timing diagram for sensing the characteristics of the driving transistor in the display device according to one or more embodiments.

Referring to FIG. 11, in the display device 100 according to one or more embodiments, the states of the driving transistor DRT are initialized to the same condition by swing the gate node-source node voltage Vgs of the driving transistor DRT between a positive value and a negative value before the characteristic value of the driving transistor DRT is sensed.

For this purpose, it is preferable for the display device 100 according to one or more embodiments to swing and supply the data voltage Vdata at a starting stage of a sensing period (threshold voltage sensing, mobility sensing) for sensing a characteristic value of the driving transistor DRT in compared with the image driving period of the display device 100.

In this case, the sensing period for sensing the characteristic value of the driving transistor DRT may proceed after the display device 100 powers on and before the image driving starts. These sensing and sensing process are referred to as on-sensing and on-sensing process. Alternatively, the sensing period for sensing the characteristic value of the driving transistor DRT may proceed after the display device 100 powers off. Such sensing and sensing processes are referred to as off-sensing and off-sensing process.

Alternatively, the sensing period of the driving transistor DRT may proceed in real time during the image driving. This sensing process is referred to as a real-time sensing (RT sensing) process. In the case of the RT sensing process, the sensing period may be proceed for one or more subpixels SP in one or more subpixel SP lines during each blank period in the image driving period.

When the sensing process is performed at the blank period, the subpixel SP line where the sensing process is performed may be selected at random. Thus, the image error appeared in the image driving period may be reduced after the sensing process has performed during the blank period. In addition, the recovery data voltage may be supplied to the subpixel SP, in which the sensing process is performed in the image driving period, after the sensing process is performed during the blank period. Accordingly, the image error appeared in the subpixel SP line may be further reduced when the recovery process is completed in the image driving period after the sensing process during the blank period.

On the other hand, in the case of the sensing process for the threshold voltage of the driving transistor DRT, Off-sensing process which takes a little long time may proceed since it takes a long time to saturate the voltage at the second node N2 of the driving transistor DRT. On the other hand, in the case of the sensing process for the mobility of the driving transistor DRT, on-sensing process and/or RT sensing process which take a little short time may proceed since it takes a relatively short time compared to the sensing process for the threshold voltage.

For the display device 100 according to one or more embodiments, the states of the driving transistor DRT are initialized to the same condition to minimize or to reduce the influence of the subpixel SP from the previous frame by swing the gate node-source node voltage Vgs of the driving transistor DRT between a positive value and a negative value before the characteristic value of the driving transistor DRT in the display device 100 is sensed.

For the purpose, it is preferable to swing the gate node-source node voltage Vgs of the driving transistor DRT to a positive value and a negative value before the capacitance of the storage capacitor Cst is transferred to the deterioration sensing circuit 131 in the sensing period for sensing the characteristic value of the driving transistor DRT. At this time, since the time at which the capacitance charged in the storage capacitor Cst of the driving transistor DRT is transmitted to the deterioration sensing circuit 131 is a tracking period TRACKING and sampling period SAMPLING among the sensing period for sensing the characteristic value of the driving transistor DRT, it is preferable to swing the gate node-source node voltage Vgs of the driving transistor DRT to a positive value and a negative value in the initializing period INITIAL.

At this time, the gate node-source node voltage Vgs of the driving transistor DRT may be adjusted by controlling the data voltage Vdata applied to the gate node of the driving transistor DRT.

Particularly, since the data voltage Vdata corresponds to a value obtained by converting the image data supplied from the timing controller 140 into the analog data in the data driver circuit 130, it is effective that the timing controller 140 controls the data driver circuit 130 to swing the gate node-source node voltage Vgs of the driving transistor DRT between a positive value and a negative value in the initializing period INITIAL among the sensing period for the characteristic value of the driving transistor DRT. Of course, it is also possible to construct a circuit capable of controlling the data voltage Vdata in a module form inside the data driver circuit 130.

At this time, it is beneficial to set the voltage level of the data voltage Vdata for swinging up and down in order to swing the gate node-source node voltage Vgs of the driving transistor DRT to a positive value and a negative value.

Figure 12:
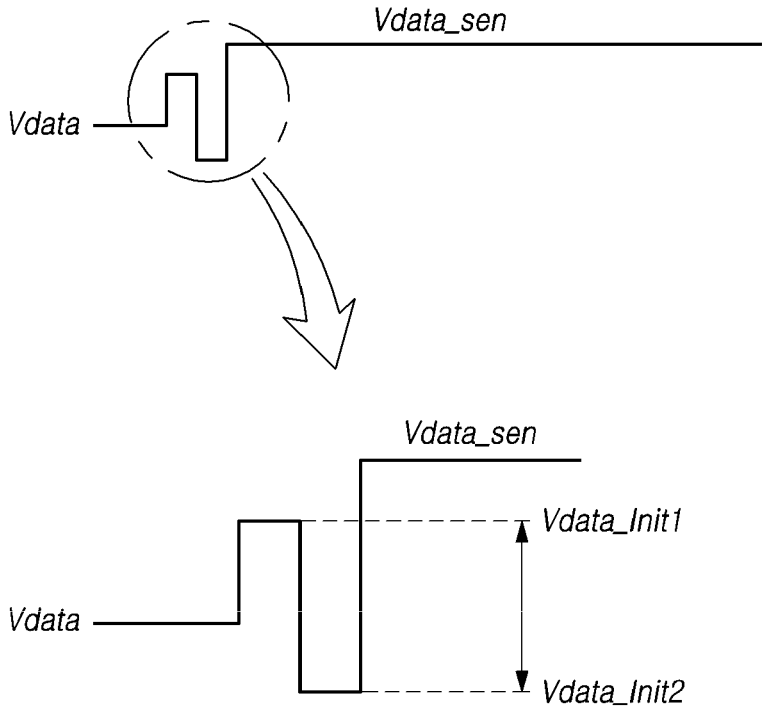
FIG. 12 illustrates an exemplary data voltage supplied for initializing the driving transistor in the display device according to one or more embodiments.

FIG. 12 illustrates an exemplary data voltage supplied for initializing the driving transistor in the display device according to one or more embodiments.

Referring to FIG. 12, for the display device according to one or more embodiments, the data voltage Vdata may be applied with a first initializing voltage Vdata_Init1 in the initializing period INITIAL among the sensing period for sensing the characteristic value of the driving transistor DRT, and after a certain time passes, may be applied with a second initializing voltage Vdata_Init2 in order to swing the gate node-source node voltage Vgs of the driving transistor DRT to a positive value and a negative value.

Here, the first initializing voltage Vdata_Init1 is a level for adjusting the gate node-source node voltage Vgs of the driving transistor DRT to a positive value, and the second initializing voltage Vdata_Init2 is a level for adjusting the gate node-source node voltage Vgs of the driving transistor DRT to a negative value.

After the first initializing voltage Vdata_Init1 and the second initializing voltage Vdata_Init2 are applied, the data voltage Vdata is applied with a level of the data voltage-for-sensing Vdata_sen used for sensing the characteristic value of the driving transistor DRT. At this time, the data voltage-for-sensing Vdata_sen may have a higher value or lower value than the first initializing voltage Vdata_Init1.

Figure 13:
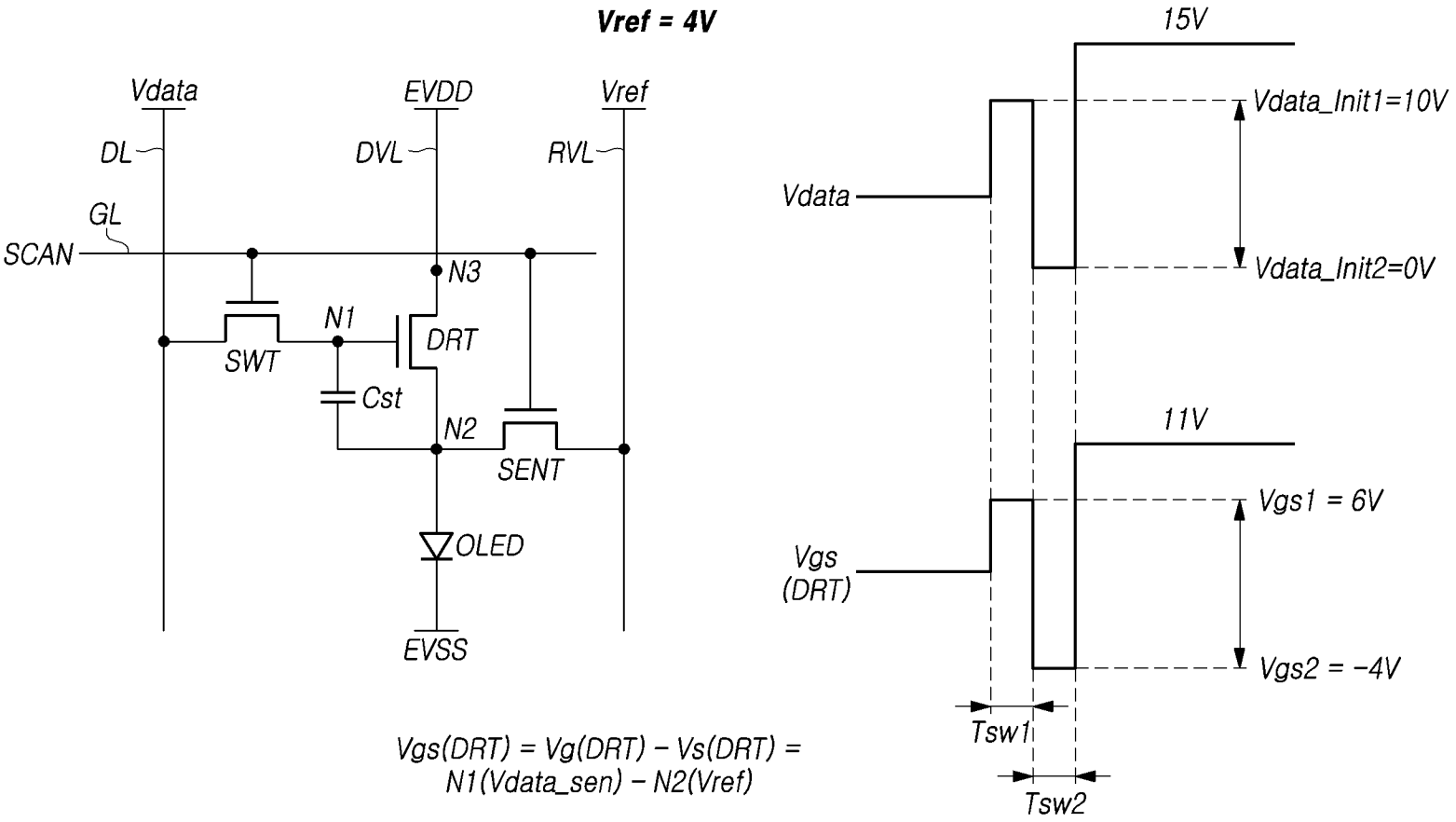
FIG. 13 illustrates an exemplary diagram showing variation of the gate node-source node voltage in the driving transistor according to the data voltage variation in the display device.

FIG. 13 illustrates is an exemplary diagram showing variation of the gate node-source node voltage in the driving transistor according to the data voltage variation in the display device.

Referring to FIG. 13, the gate node-source node voltage Vgs of the driving transistor DRT corresponds to the difference between the voltage Vg at the gate node and the voltage Vs at the source node, which corresponds to the difference between the data voltage Vdata and the reference voltage-for-sensing Vref in the state that the switching transistor SWT and the sensing transistor SENT are turned on by the gate line GL signal with a high level. That is, the gate node-source node voltage of the driving transistor DRT is Vgs(DRT)=Vg(DRT)−Vs(DRT)=Vdata−Vref.

Accordingly, it is possible for the data voltage Vdata applied to the data line DL and the reference voltage-for-sensing Vref to be set appropriately in order to determine the swing level of the gate node-source node voltage Vgs of the driving transistor DRT. At this time, since the data voltage Vdata generally has a positive value, it is preferable for the reference voltage-for-sensing Vref to have a positive value in order to swing the gate node-source node voltage Vgs of the driving transistor DRT to a positive value and a negative value. That is, the gate node-source node voltage Vgs of the driving transistor DRT may be swung to a negative value by setting the reference voltage-for-sensing Vref to a positive value, since the lower limit of the data voltage Vdata corresponds to 0V.

For example, when the reference voltage-for-sensing Vref is 4V, the gate node-source node voltage Vgs of the driving transistor DRT may swing between the first voltage Vgs1 of 6V and the second voltage Vgs2 of −4V by controlling the first initializing voltage Vdata_Init1 of the data voltage Vdata to 10V and the second initializing voltage Vdata_Init2 to 0V.

As a result, since the gate node-source node voltage Vgs of the driving transistor DRT swings between 6V and −4V, the state of the driving transistor DRT is initialized, and the influence of the residual image remaining in the subpixel SP of the previous frame is reduced or minimized.

At this time, since it is effective for the gate node-source node voltage Vgs of the driving transistor DRT to control in the initializing period INITIAL among the sensing period for sensing the characteristic value of the driving transistor DRT, it is preferable that the applied time Tsw1 of the first initializing voltage Vdata_Init1 and the applied time Tsw2 of the second initializing voltage Vdata_Init2 are within the initializing period INITIAL among the sensing period for sensing the characteristic value of the drive transistor DRT.

Although the switching transistor SWT and the sensing transistor SENT are connected to one gate line GL so that the switching transistor SWT and the sensing transistor SENT are simultaneously turned on or turned off by the scan signal SCAN, it is also possible to apply the same to the case that the scan signal SCAN may be applied to the gate node of the switching transistor SWT and the sense signal SCAN may be applied to the gate node of the sensing transistor SENT from the separated structure as described above.

As described above, the display device 100 according to one or more embodiments may reduce or minimize the influence of the residual image remaining in the subpixel SP in the previous frame and accurately sense the characteristic value of the driving transistor DRT by initializing the state of the driving transistor DRT with swinging the gate node-source node voltage Vgs of the driving transistor DRT to a positive value and a negative value in a sensing period for sensing the characteristic value of the driving transistor DRT.

The foregoing descriptions and the accompanying drawings have been presented in order to explain certain principles of the present disclosure by way of example. A person having ordinary skill in the art related to the present disclosure could make various modifications and variations to the present disclosure without departing from the principle of the present disclosure. The foregoing embodiments disclosed herein shall be interpreted as being illustrative, while not being limitative, of the principle and scope of the present disclosure.

The various embodiments described above can be combined to provide further embodiments. Further changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A display device, comprising:

a display panel including a plurality of gate lines, a plurality of data lines, and a plurality of subpixels;

a gate driver circuit driving the plurality of gate lines;

a data driver circuit driving the plurality of data lines; and a timing controller applying signals to the gate driver circuit and the data driver circuit, wherein, for each of the plurality of subpixels, the timing controller initializes a state of a driving transistor by controlling a data voltage applied to the display panel from the data driver circuit in a sensing period for sensing a characteristic value of the driving transistor, wherein the sensing period for sensing the characteristic value of the driving transistor includes:

an initializing period in which a data voltage-for-sensing is supplied to the subpixel to be sensed through the data line, and a reference voltage-for-sensing is supplied to the subpixel to be sensed through a reference voltage line;

a tracking period in which the reference voltage-for-sensing is blocked; and a sampling period in which a current flowing through the reference voltage line is sensed.

2. The display device according to claim 1, wherein each of the plurality of subpixels includes:

an organic light-emitting diode driven by the driving transistor;

a switching transistor electrically connected between a gate node of the driving transistor and a data line among the plurality of data lines;

a sensing transistor electrically connected between either a source node or a drain node of the driving transistor and a reference voltage line; and a storage capacitor electrically connected between the gate node of driving transistor and either a source node or a drain node of the switching transistor.

3. The display device according to claim 1, wherein a voltage of the reference voltage line is increased in response to the reference voltage-for-sensing being blocked during the tracking period.

4. The display device according to claim 1, wherein the timing controller controls the data voltage applied to the display panel to a first initializing voltage and a second initializing voltage in the initializing period to swing a gate node-source node voltage of the driving transistor between a positive value and a negative value.

5. The display device according to claim 1, wherein the reference voltage-for-sensing has a positive level in the initializing period.

6. The display device according to claim 1, further comprising a deterioration sensing circuit for sensing a characteristic value of the driving transistor.

7. The display device according to claim 6, wherein the deterioration sensing circuit includes:

an amplifier having an inverting input terminal electrically connected to the reference voltage line and a non-inverting input terminal supplied with a reference voltage-for-comparing;

a feedback capacitor electrically connected between the inverting input terminal and an output terminal of the amplifier;

an initializing switch electrically connected to the feedback capacitor; and a sampling switch electrically connected to the output terminal of the amplifier.

8. The display device according to claim 7, wherein the initializing switch is electrically connected in parallel with the feedback capacitor.

9. The display device according to claim 7, wherein the initializing switch is in a turn-off state and the sampling switch is in a turn-on state during the sampling period.

10. A method of sensing a characteristic value of a circuit element in a display panel, the method comprising:

supplying a first initializing voltage to a subpixel to be sensed through a data line, and supplying a second initializing voltage to the subpixel to be sensed through the data line;

supplying a data voltage-for-sensing to the subpixel to be sensed through the data line, and supplying a reference voltage-for-sensing to the subpixel to be sensed through a reference voltage line;

blocking the reference voltage-for-sensing and increasing a voltage of the reference voltage line in response to the reference voltage-for-sensing being blocked; and sensing a current flowing through the reference voltage line.

11. The method according to claim 10, wherein the reference voltage-for-sensing has a positive level.

12. The method according to claim 10, wherein the subpixel includes:

an organic light-emitting diode;

a driving transistor driving the organic light-emitting diode, the driving transistor including a source node, a gate node, and a drain node;

a switching transistor electrically connected between the gate node of the driving transistor and a data line;

a sensing transistor electrically connected between either the source node or the drain node of the driving transistor and the reference voltage line; and a storage capacitor electrically connected between the gate node of the driving transistor and either a source node or a drain node of the switching transistor.

13. The method according to claim 11, wherein the display panel further includes:

an amplifier having an inverting input terminal electrically connected to the reference voltage line and a non-inverting input terminal supplied with a reference voltage-for-comparing;

a feedback capacitor electrically connected between the inverting input terminal and an output terminal of the amplifier;

an initializing switch electrically connected to the feedback capacitor; and a sampling switch electrically connected to the output terminal of the amplifier, wherein the initializing switch is in a turn-off state and the sampling switch is in a turn-on state when the current flowing through the reference voltage line is sensed.

14. The method according to claim 10, wherein the first initializing voltage and the second initializing voltage are set to different levels to swing a gate node-source node voltage of the driving transistor between a positive value and a negative value.

* * * * *